US005585026A

United States Patent [19]

Smith, Jr. et al.

[11] Patent Number: 5,585,026

[45] Date of Patent: Dec. 17, 1996

[54] HEATED GRIP FOR A BOW HANDLE

[76] Inventors: Derril R. Smith, Jr., Rd. #1 Box 36; Richard Q. Dodson, Rd. #1 Box 51, both of Loganton, Pa. 17747

[21] Appl. No.: 369,088

[22] Filed: Jan. 5, 1995

[51] Int. Cl.[6] ..... H05B 3/34

[52] U.S. Cl. ..... 219/535; 219/528

[58] Field of Search ..... 219/528, 529, 219/535, 536, 209, 211, 549, 545

[56] References Cited

U.S. PATENT DOCUMENTS

| | | | |
|---|---|---|---|
| 2,889,439 | 6/1959 | Musgrave | 219/528 |
| 3,031,739 | 5/1962 | Boggs | 219/528 |
| 4,245,149 | 1/1981 | Fairlie | 219/528 |
| 4,279,255 | 7/1981 | Hoffman | 219/528 |
| 4,862,436 | 8/1989 | Harilela | 368/282 |
| 5,302,807 | 4/1994 | Zhao | 219/211 |
| 5,394,615 | 3/1995 | Hoppe | 33/265 |
| 5,432,322 | 7/1995 | Ingram et al. | 219/528 |
| 5,436,429 | 7/1995 | Cline | 219/528 |
| 5,441,789 | 8/1995 | Walker | 428/78 |

*Primary Examiner*—Teresa J. Walberg
*Assistant Examiner*—Sam Paik

[57] ABSTRACT

A heated grip for a bow handle including a flexible grippable planar heating element mechanism for dissipating heat when electrically energized; a coupling mechanism for coupling the heating element mechanism to a bow handle; and a power source mechanism removably securable to a bow handle for supplying electrical energy to the heating element mechanism.

7 Claims, 4 Drawing Sheets

FIG. 1
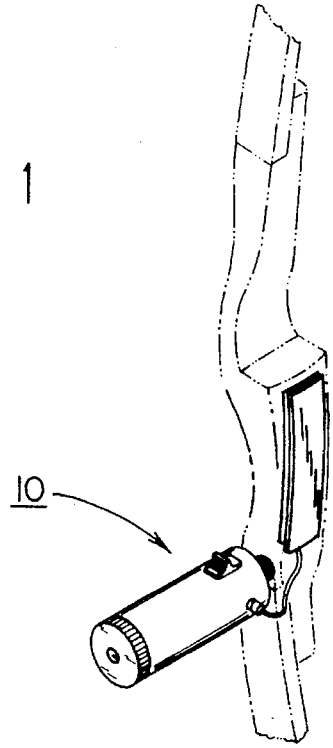
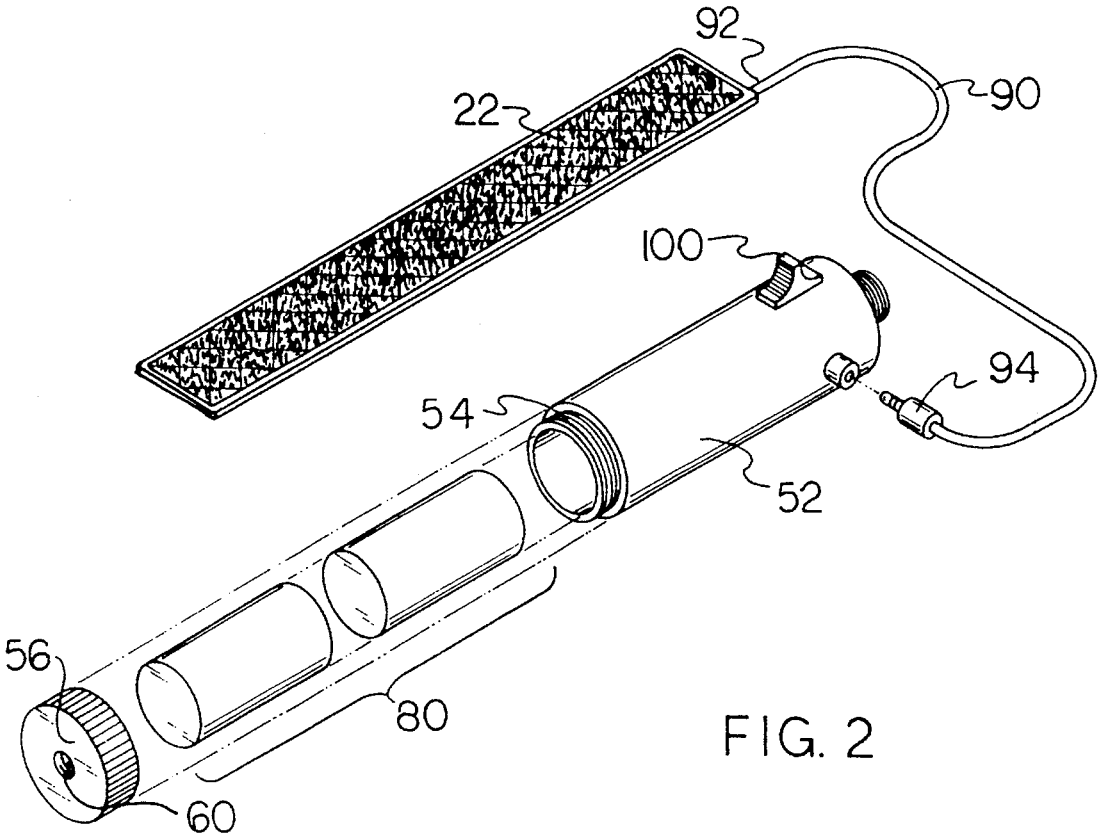
FIG. 2

FIG 7
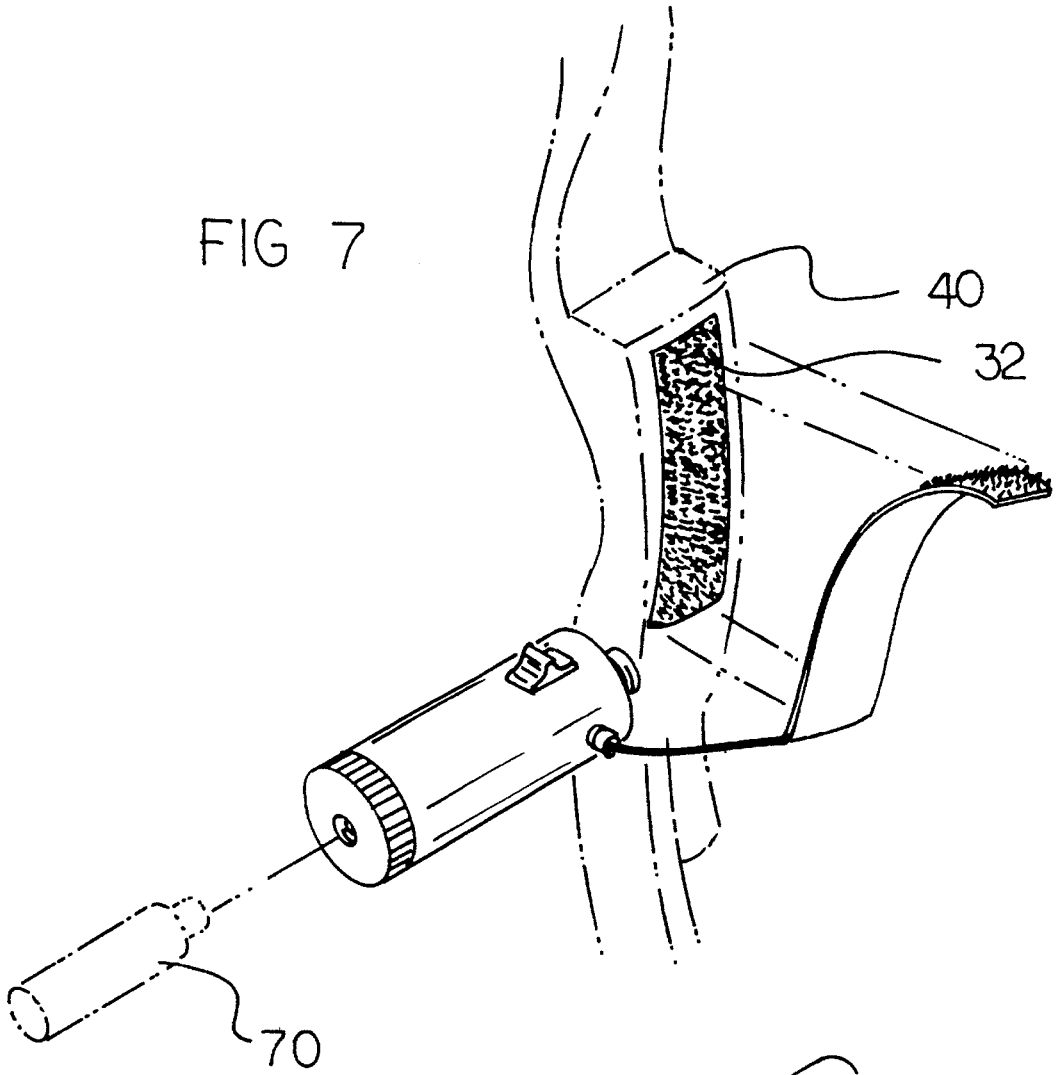
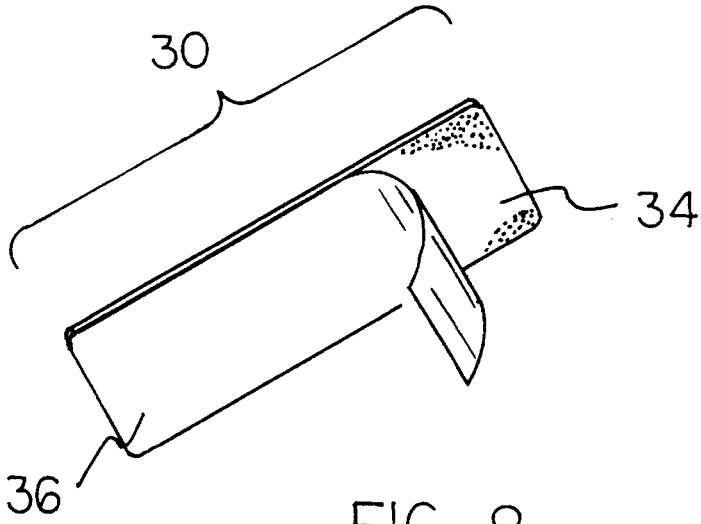
FIG 8

HEATED GRIP FOR A BOW HANDLE

BACKGROUND OF THE INVENTION

1. Field of the Invention

The present invention relates to a heated grip for a bow handle and more particularly pertains to allowing an archer's hand to be warmed while holding a bow handle with a heated grip.

2. Description of the Prior Art

The use of heated grips for bows is known in the prior art. More specifically, heated grips for bows heretofore devised and utilized for the purpose of allowing an archer to warm his hands are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,887,790 to Ferguson discloses a rap-around electric resistance heater. U.S. Pat. No. 4,471,209 to Hollander discloses electrically heated hand grips for vehicle handlebars. U.S. Pat. No. 4,584,787 to Aho discloses a heated handle structure. U.S. Pat. No. 4,598,192 to Garrett discloses an electrically heated handle for fishing rods. U.S. Pat. No. 4,646,461 to McLeod discloses a fishing rod with heated handle. U.S. Pat. No. 4,937,429 to Hollander discloses heated hand grips and method of manufacturer.

While these devices fulfill their respective, particular objective and requirements, the aforementioned patents do not describe a heated grip for a bow handle that allows an archer to warm his hand while holding the bow handle, thereby allowing the archer to shoot with increased accuracy in cold weather.

In this respect, the heated grip for a bow handle according to the present invention substantially departs from the conventional concepts and designs of the prior art, and in doing so provides an apparatus primarily developed for the purpose of allowing an archer's hand to be warmed while holding a bow handle.

Therefore, it can be appreciated that there exists a continuing need for new and improved heated grip for a bow handle which can be used for allowing an archer's hand to be warmed while holding a bow handle. In this regard, the present invention substantially fulfills this need.

SUMMARY OF THE INVENTION

In the view of the foregoing disadvantages inherent in the known types of heated grips for bows now present in the prior art, the present invention provides an improved heated grip for a bow handle. As such, the general purpose of the present invention, which will be described subsequently in greater detail, is to provide a new and improved heated grip for a bow handle and method which has all the advantages of the prior art and none of the disadvantages.

To attain this, the present invention essentially comprises, in combination, a section of heat tape formed a layer of fiber padding having an upper surface and a lower surface, an electrically conductive elongated heating element serpentinely extended through the layer of fiber padding for dissipating heat when electrically energized, a first strip of pile type fastener coupled to the lower surface of the layer of fiber padding, and a cover disposed over the upper surface of the layer of fiber padding and coupled to the first strip. A second strip of complementary pile type fastener is included and has an upper surface and a lower surface with a layer of adhesive applied to the lower surface and a peel-off backing covering the adhesive. The backing is removable for coupling the second strip to a bow handle. The second strip of complementary pile type fastener is further coupleable with the first strip of pile type fastener for placing the section of heat tape in an operable stationary position on a bow handle. A rigid housing is included and formed of a tube having an open threaded first end with an end cap threadedly coupled thereto and a sealed second end with a threaded bolt extended axially therefrom. The threaded bolt on the second end is threadedly coupleable to a bow handle in place of a stabilizer bar. The cap further includes an axially aligned threaded bore disposed therethrough for allowing securement of a stabilizer bar. A power source is included for supplying electrical energy. The power source is disposed within the housing and secured therein with the end cap. A power cable is included and has a terminal end and a plug end with the terminal end coupled to the heating element within the section of heat tape. A power switch is included and coupled to the housing and the power source and removably coupled to the plug end of the power cable. The power switch has an enabled orientation for allowing electrical energy to be delivered to the heating element and a disabled orientation for preventing electrical energy from being delivered to the heating element.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved heated grip for a bow handle which has all the advantages of the prior art heated grips for bows and none of the disadvantages.

It is another object of the present invention to provide a new and improved heated grip for a bow handle which may be easily and efficiently manufactured and marketed.

It is a further object of the present invention to provide a new and improved heated grip for a bow handle which is of durable and reliable construction.

An even further object of the present invention is to provide a new and improved heated grip for a bow handle which is susceptible of a low cost of manufacture with regard to both materials and labor, and which accordingly is then susceptible of low prices of sale to the consuming public, thereby making such a heated grip for a bow handle economically available to the buying public.

Still yet another object of the present invention is to provide a new and improved heated grip for a bow handle which provides in the apparatuses and methods of the prior art some of the advantages thereof, while simultaneously overcoming some of the disadvantages normally associated therewith.

Even still another object of the present invention is to provide a new and improved heated grip for a bow handle comprising flexible grippable planar heating element means for dissipating heat when electrically energized; coupling means for coupling the heating element means to a bow handle; and power source means removably securable to a bow handle for supplying electrical energy to the heating element means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention secured to a bow handle in place of its stabilizer bar.

FIG. 2 is an exploded perspective view of the present invention when removed from a bow handle.

FIG. 7 is a perspective view of the pile type coupling mechanism used for securing the heat tape to the bow handle.

FIG. 8 is a perspective view of the strip of complementary pile type fastener coupleable to a bow handle for holding the section of heat tape in a stationary configuration.

The same reference numerals refer to the same parts through the various Figures.

DESCRIPTION OF THE PREFERRED EMBODIMENT

With reference now to the drawings, and in particular, to FIG. 1 thereof, the preferred embodiment of the new and improved heated grip for a bow handle embodying the principles and concepts of the present invention and generally designated by the reference number 10 will be described.

The present invention is comprised of a plurality of components. In their broadest context, such components include a section of heat tape, a housing, and a switchable power source. Such components are individually configured and correlated with respect to each other to provide the intended function of allowing an archer to warm his hand while holding a bow handle.

Figure 3:
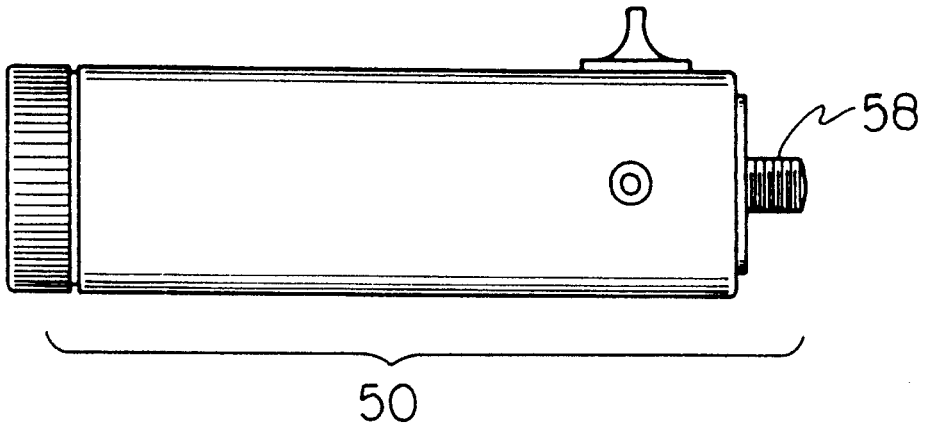
FIG. 3 is a side elevational view of the housing and power switch means of the present invention.
Figure 4:
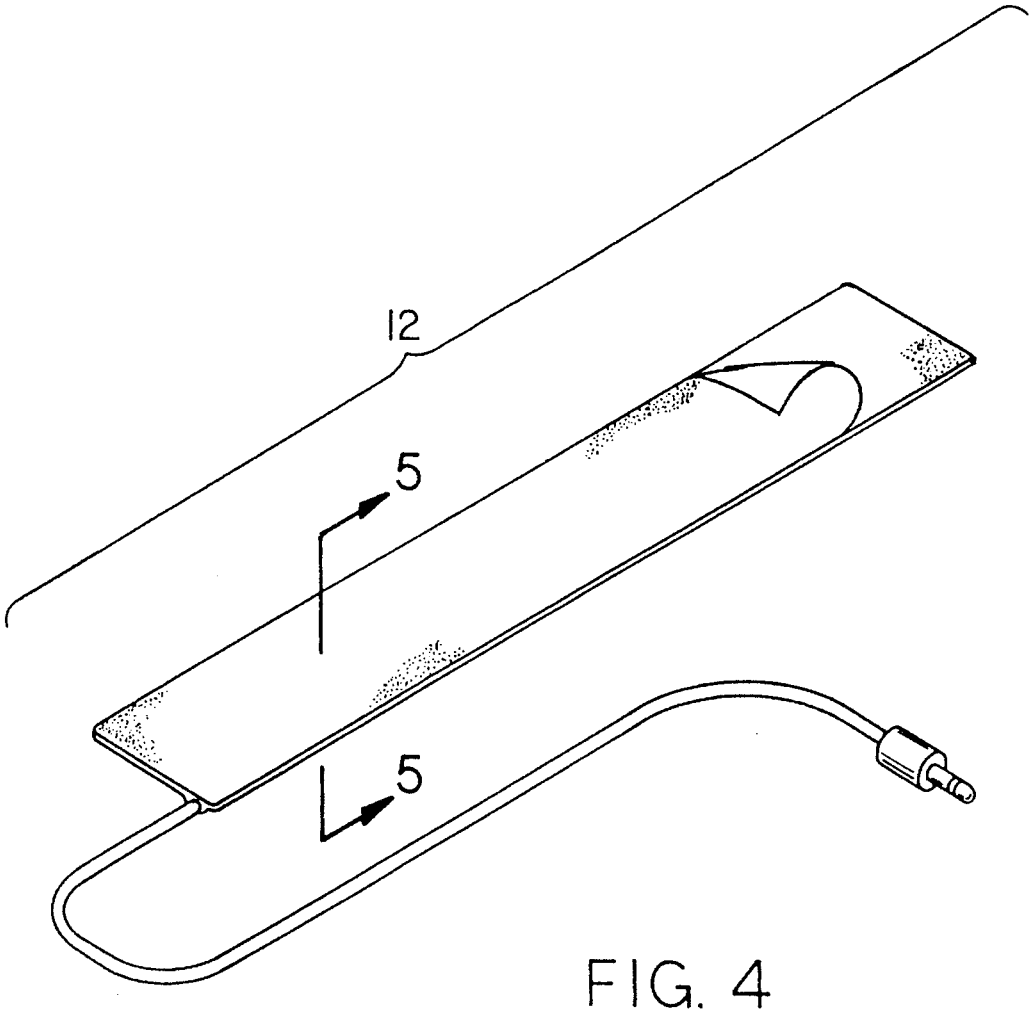
FIG. 4 is a perspective view of the strap and power cable of the present invention.
Figure 5:
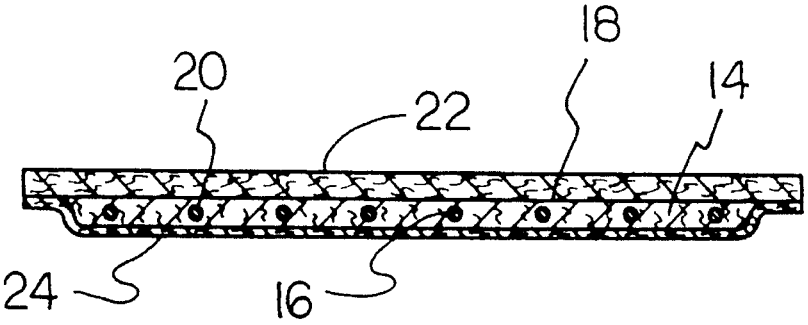
FIG. 5 is a cross-sectional view of the present invention taken along the line 5—5 of FIG. 4.
Figure 6:
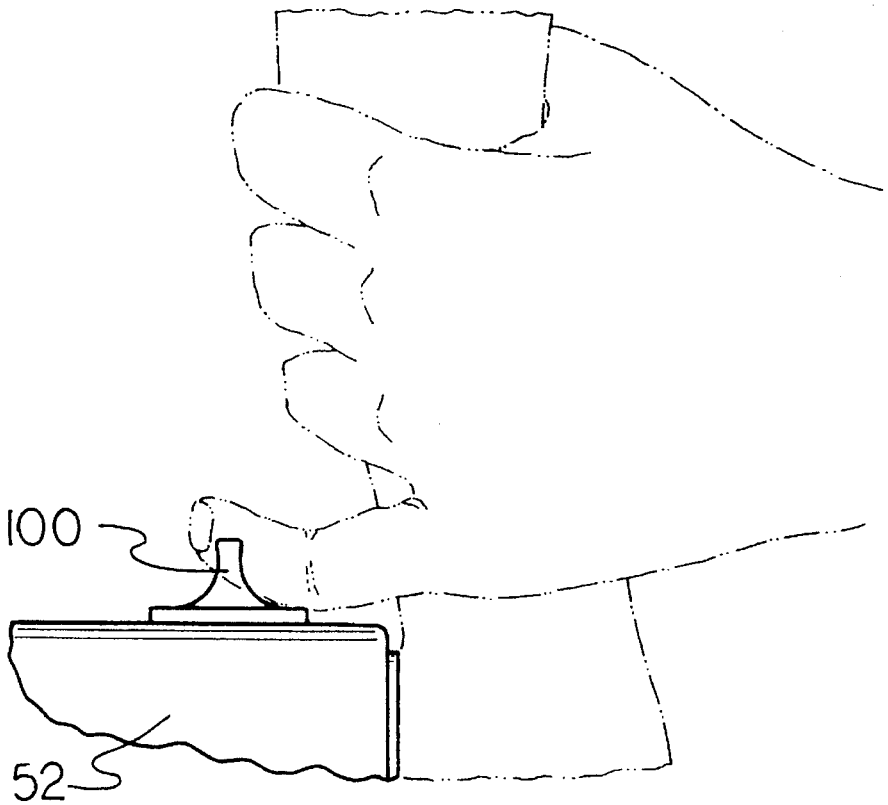
FIG. 6 is a side elevational view of the present invention and its coupling with a bow handle at a location for allowing the archer to place the power switch means in an enabled orientation with his little finger while simultaneously holding the bow handle.

Specifically, the present invention includes a section of heat tape 12. As shown in FIG. 5, the heat tape is formed of a layer of thermally conductive fiber padding 14 having an upper surface 16 and a lower surface 18. Also included is an electrically conductive, flexible, and elongated heating element 20. The heating element is serpentinely extended through the central extent of the layer of fiber padding. The heating element dissipates heat when electrically energized. The section of heat tape also includes a first strip of pile-type fastener 22 coupled to the lower surface of the layer of fiber padding. A water proof and thermally conductive plastic cover 24 is disposed over the upper surface of the layer of fiber padding and then secured to the first strip, thereby sealing the fiber padding therebetween. The cover protects the heating element from electrically shorting out when the present invention encounters precipitative conditions.

To secure the section of heat tape to a bow handle for use, a second strip of complimentary pile-type fastener 30 is provided. The second strip has an upper surface 32 and a lower surface. A layer of adhesive 34 is applied to the lower surface of the second strip. Furthermore, a peel-off paper backing 36 covers the adhesive. The backing is removable for allowing the second strip to be secured to a bow handle as shown in FIG. 7. The second strip of complimentary pile-type fastener is coupleable with the first strip of pile-type fastener 22 for placing the section of heat tape 12 in an operable stationary position on a bow handle 40.

A rigid aluminum housing 50 is also included. The housing is formed of a tube 52 having an open threaded first end 54 and a sealed second end. An electrically conductive first contact is secured within the tube at the second end thereof. Furthermore, an electrically conductive elongated terminal is secured on the inside of the tube and along the length thereof and coupled to the first contact. An end cap 56 is threadedly coupled to the first end for sealing the housing. The cap has an electrically conductive and spring-loaded second contact secured to the inner surface thereof that is operatively coupled with the terminal of the tube when the cap is threadedly coupled thereto. A threaded bolt 58 is extended axially from the second end. This bolt is threadedly coupleable to a bow handle near the grip thereof in place of its stabilizer bar. The end cap further has an axially aligned threaded bore 60 disposed therethrough. Bore 60 thus allows the threadable securement of a stabilizer bar 70 to the bow handle as shown in FIG. 7.

Also provided is a power source 80. The power source is used for supplying electrical energy for operation. The power source is removably disposed within the housing 52 and secured therein with the end cap 56. The power source is formed of two C-sized commercially available and replaceable batteries positioned in an end-to-end configuration. The positive pole of one of the batteries is abutted against the first contact of the housing and the negative pole of the other battery is abutted against the second contact of the housing to thereby place the batteries in an operable orientation.

To transfer electrical energy from the power source to the heat tape 12, a sheathed power cable 90 is utilized. The power cable has a terminal end 92 and a plug end 94. The terminal end is fixedly coupled to the heating element 20 within the section of heat tape. The power cable has a length such that when the heat tape is secured to a grippable portion of the bow handle, the cable can extend to a location near where a stabilizer bar would be located.

Lastly, a power switch 100 is coupled to the tube 52. The power switch is further electrically coupled to the power source 80 through the first contact and removably coupled with the plug end 94 of the power cable. The power switch has an enabled orientation for allowing electrical energy to be delivered to the heating element for heating the section of heat tape. The power switch also has a disabled orientation for preventing electrical energy from being delivered to the heating element.

In operation, the housing is secured to a bow handle in place of its stabilizer bar. The second strip is secured to a bow handle. The heat tape is then secured to the second strip, and the power cable thereof is coupled to the power switch on the housing. Now, by placing the power switch in the enabled orientation, the heating element is electrically energized, and heat is dissipated through the heating element for warming an archer's hand that is placed upon the heat tape and gripping the bow handle.

The present invention is designed to keep a bow-holding hand warm while hunting or competition shooting. The power switch is placed at a position on the housing such that it is switchable with the little finger of an archer's bow-holding hand. The power source consists of two C-sized batteries for supplying current to the heating element for dissipating heat. The heat tape fastens to a bow handle of a bow for keeping the finger tips and hand warm. In the preferred embodiment the housing is made of aluminum. The housing has a diameter of about 3 ¼ inches and an axial length of about 4 ¼ inches. The section of heat tape is about five inches long and about one inch wide.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A heated grip for a bow handle for allowing an archer to warm his hand while holding the bow handle comprising, in combination:

a section of heat tape formed a layer of fiber padding having an upper surface and a lower surface, an electrically conductive elongated heating element serpentinely extended through the layer of fiber padding for dissipating heat when electrically energized, a first strip of pile type fastener coupled to the lower surface of the layer of fiber padding, and a cover disposed over the upper surface of the layer of fiber padding and coupled to the first strip;

a second strip of complementary pile type fastener having an upper surface and a lower surface with a layer of adhesive applied to the lower surface and a peel-off backing covering the adhesive, the backing removable for coupling the second strip to a bow handle, the second strip of complementary pile type fastener further coupleable with the first strip of pile type fastener for placing the section of heat tape in an operable stationary position on a bow handle;

a rigid housing formed of a tube having an open threaded first end with an end cap threadedly coupled thereto and a sealed second end with a threaded bolt extended axially therefrom and threadedly coupleable to a bow handle in place of a stabilizer bar, the cap further having an axially aligned threaded bore disposed therethrough for allowing securement of a stabilizer bar;

a power source for supplying electrical energy disposed within the housing and secured therein with the end cap;

a power cable having a terminal end and a plug end with the terminal end coupled to the heating element within the section of heat tape; and a power switch coupled to the housing and the power source and removably coupled to the plug end of the power cable, the power switch having an enabled orientation for allowing electrical energy to be delivered to the heating element and a disabled orientation for preventing electrical energy from being delivered to the heating element.

2. A heated grip for a bow handle comprising:

flexible grippable planar heating element means for dissipating heat when electrically energized;

coupling means for coupling the heating element means to a bow handle; and power source means removably securable to a bow handle in place of a stabilizer bar thereof for supplying electrical energy to the heating element means.

3. The heated grip for a bow handle as set forth in claim 2 further including a power switch coupled between the heating element means and power source means and with the power switch having an enabled orientation for allowing electrical energy to be delivered to the heating element and a disabled orientation for preventing such delivery.

4. The heated grip for a bow handle as set forth in claim 2 wherein the heating element means comprises a section of heat tape formed a layer of fiber padding and an electrically conductive elongated heating element serpentinely extended through the layer of fiber padding.

5. The heated grip for a bow handle as set forth in claim 2 wherein the power source means comprises:

a hollow housing;

a power source formed of at least one battery removably secured within the housing; and a power cable having one end coupled to the heating element means and another end coupled to the power source.

6. The heated grip for a bow handle as set forth in claim 2 wherein the coupling means is formed of a pile type fastener secured to the heating element means and complementary pile type fastener secured to a bow handle.

7. The heated grip for a bow handle as set forth in claim 2 further including stabilizer bar holding means secured to the power source means for receivably holding an external stabilizer bar of a bow handle in an operable position.

* * * * *